US007794044B2

(12) United States Patent
Yoshikawa et al.

(10) Patent No.: US 7,794,044 B2
(45) Date of Patent: Sep. 14, 2010

(54) INK JET PRINTING APPARATUS

(75) Inventors: Hirokazu Yoshikawa, Kawasaski (JP); Hiroshi Tajika, Yokohama (JP); Hitoshi Nishikori, Inagi (JP); Daisaku Ide, Tokyo (JP); Takeshi Yazawa, Yokohama (JP); Atsuhiko Masuyama, Tokyo (JP); Akiko Maru, Kawasaki (JP); Hideaki Takamiya, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 44 days.

(21) Appl. No.: 11/047,674

(22) Filed: Feb. 2, 2005

(65) Prior Publication Data

US 2005/0174382 A1 Aug. 11, 2005

(30) Foreign Application Priority Data

Feb. 6, 2004 (JP) ..... 2004-031330

(51) Int. Cl.
*B41J 2/165* (2006.01)

(52) U.S. Cl. ..... 347/29; 347/30

(58) Field of Classification Search ..... 347/24, 347/29, 30, 32

See application file for complete search history.

(56) References Cited

U.S. PATENT DOCUMENTS 5,266,974 A * 11/1993 Koitabashi et al. ..... 347/33
5,436,652 A * 7/1995 Mizoguchi et al. ..... 347/108
5,625,385 A * 4/1997 Suzuki ..... 347/24
5,726,692 A * 3/1998 Yamaguchi et al. ..... 347/23
6,000,778 A 12/1999 Koitabashi et al.
6,145,956 A 11/2000 Koitabashi et al.
6,231,156 B1 * 5/2001 Ono ..... 347/24
6,257,696 B1 * 7/2001 Nakamura ..... 347/30
6,364,449 B1 * 4/2002 Takahashi et al. ..... 347/30
6,582,067 B2 * 6/2003 Matsuzaki et al. ..... 347/85

(Continued)

FOREIGN PATENT DOCUMENTS

JP 2000-153622 A 6/2000

(Continued)

OTHER PUBLICATIONS

Japanese Office Action in Appln. No. 2004-031330, Japanese Patent Office, (Jul. 17, 2009).

(Continued)

*Primary Examiner*—Anh T. N. Vo
(74) *Attorney, Agent, or Firm*—Fitzpatrick, Cella, Harper & Scinto

(57) ABSTRACT

A plurality of ejection portions are divided into groups, each containing at least one ejection portion, so that the suction-based recovery operation can be performed for each group independently. Since the number of ejection portions contained in each group differs, if an ink flow resistance varies among the different groups, simultaneous suction-based recovery operations can be done by using a common suction pump, without having to sequentially perform the suction-based recovery operations under an optimum pump driving condition. For this purpose, inner diameters of a plurality of ink discharge tubes running from a plurality of cap units, which cap a plurality of print head units having different numbers of ejection portions, to the common pump are differentiated. This allows different flows to be produced in different ink discharge systems, thus generating desirable ink flows for individual ink supply systems.

4 Claims, 12 Drawing Sheets

U.S. PATENT DOCUMENTS

| | | | | |
|---|---|---|---|---|
| 6,641,247 | B2 | 11/2003 | Ide et al. | |
| 6,648,447 | B2 | 11/2003 | Sugimoto et al. | |
| 6,663,218 | B2 * | 12/2003 | Uchida | 347/29 |
| 6,883,905 | B2 * | 4/2005 | Kimura et al. | 347/85 |
| 2004/0104974 | A1 | 6/2004 | Edamura et al. | |
| 2005/0041056 | A1 | 2/2005 | Ide et al. | |

FOREIGN PATENT DOCUMENTS

| | | | |
|---|---|---|---|
| JP | 2001-138552 | | 5/2001 |
| JP | 2001-205825 | A | 7/2001 |
| JP | 2002-205416 | A | 7/2002 |

OTHER PUBLICATIONS

English Translation of an Official Notice of Rejection in Appln. No. 2004-031330, Japanese Patent Office, mailed Jul. 17, 2009.

* cited by examiner

INK JET PRINTING APPARATUS

BACKGROUND OF THE INVENTION

1. Field of the Invention

The present invention relates to an ink jet printing apparatus and more particularly to a construction of a print head used in a serial scan type ink jet printing apparatus capable of high quality printing and to a maintenance method thereof.

2. Description of the Related Art

The ink jet printing method is a system for transforming input image data into an output image using a liquid ink, so that a maintenance technology for a print head that ejects ink becomes very important. Major problems that require maintenance are briefly explained here.

(a) The print head generally has a plurality of nozzles to enhance a printing speed and resolution (unless otherwise specifically noted, the nozzle generally refers to an ink ejection opening, an ink path communicating with the ink ejection opening and an element for generating an energy to eject ink). Depending on input image data, there may occur nozzles that are not used for ink ejection during a printing operation. In such nozzles ink solvent evaporates from the ejection opening, increasing an ink viscosity in the ejection opening or the ink path. Thus, when a normal ink ejection energy is applied to activate these nozzles again, they may fail to eject ink properly and stably.

(b) Ink droplets ejected from the nozzles during the printing operation include main ink droplets and fine ink droplets (also called mist), and the fine ink droplets may adhere to peripheries of the ink ejection openings of the print head. The adhering ink may in turn pull the main ink droplets being ejected out of the nozzles, resulting in the ink droplets being deviated from an intended direction, i.e., degrading a projection linearity of the main ink droplets.

(c) If there are bubbles in an ink reservoir in the print head, i.e., in the ink path deep in the nozzle or a common ink chamber communicating with the ink path, a gas that has migrated through the material making up the nozzles and the print head may be trapped in the bubbles, thereby inflating them. The bubbles may also become inflated as the temperature increases during the printing operation. This prevents a smooth supply of ink from an ink source, resulting in an ink ejection failure.

To solve the above problems (a) to (c), the following maintenance techniques may be adopted.

(A) Depending on the time during which the ink ejection has not been performed and on the environment, a predetermined amount of ink is ejected to discharge viscous ink. This is done apart from the ink ejection operation that is performed to form an image on a print medium (this operation is referred to as a preliminary ejection).

(B) The number of times that the ink has been ejected from the nozzles is counted, and when the count value exceeds a predetermined value, a surface of the print head formed with ejection openings (referred to as an ejection face) is wiped by a wiping member (such as a blade) made of an elastic material such as rubber to remove the adhering ink from the ejection face (this operation is called a wiping).

(C) A suction force is applied to the ejection face as by a pump at a predetermined timing to suck out ink from the ejection openings to forcibly draw out ink from inside the ejection openings for the recovery of an ink ejection performance (this operation is referred to as a suction-based recovery operation). In a construction in which the print head and an ink tank as an ink source are separably combined so that the ink tank can be replaced, when the ink tank is separated for replacement, an ink supply system is open admitting a gas (air). Some apparatus perform the above-mentioned suction-based recovery operation after the ink tank is replaced, to remove the gas from the ink supply system.

Here, the wiping operation and the suction-based recovery operation will be explained briefly.

FIG. 1A and FIG. 1B show a print head as seen from its ejection face and side. Reference number 1101 represents a blade made of rubber to perform wiping, 1102 the ejection face, 1103 ejection openings, 1104 adhering ink, and 1105 a wiping direction. The wiping is an operation that, as shown in the figures, involves moving the blade 1101 in the direction of arrow 1105 while holding it in contact with the print head, thereby wiping the adhering ink 1104 off the ejection face 1102 by the blade.

The suction-based recovery operation on the other hand generally involves having a cap of rubber pressed against the ejection face 1102 to form a hermetically enclosed space therein and operating a suction pump communicating to the cap to generate a negative pressure to suck out ink from the ejection openings or nozzles 1103 of the print head into the cap so that the ink drawn out is discharged through an ink discharge tube connected to the suction pump.

The suction pump may be of a tube pump type which comprises a holding member formed with a curved surface along which to hold a flexible ink discharge tube, a roller capable of pressing the ink discharge tube against the holding member, and a rotatable roller support supporting the roller. That is, by rotating the roller support in a predetermined direction, the roller is pressed against and flattens the ink discharge tube as it rotates over the holding member. As a result, a negative pressure is created in the enclosed space in the cap, sucking out ink from the nozzles which is then drawn into the ink discharge tube and the suction pump. The Ink is further moved toward an appropriate member (a waste ink holding member such as an absorbent).

In today's ink jet printing apparatus on which there are growing demands for higher print quality and speed, the number of inks used and the number of nozzles arrayed in the print head are significantly greater than those of several years ago. Thus, the maintenance technology for the print head assumes a growing importance.

Now, a current trend for higher image quality in the ink jet printing apparatus is briefly described.

Conventionally, in the ink jet printing apparatus a color reproduction is made basically by a subtractive color mixing using three primary colors, yellow, magenta and cyan. For an improved image quality, some printing apparatus use a black ink in addition to the three primary color inks to represent a high contrast; others use light inks with lower colorant contents (light cyan ink and light magenta ink) to improve color tone; and others introduce an ink droplet atomizing technology to reduce a granular impression of an output image.

For an even further improvement in image quality, a variety of technologies are being developed, such as one using special inks (color inks other than cyan, magenta and yellow inks) that cover a range of color or gamut that cannot be expressed by the above six color inks, or one using color pigment inks that make for an improved fastness of an output image, or one using a liquid that, when applied to a print medium before or after ink is applied, improves a glossiness.

One such ink let printing apparatus for improving the image quality is available (for example, see Japanese Patent Application Laid-open No. 2001-138552) which, in addition to black, cyan, magenta, yellow, light cyan and light magenta inks, uses an orange ink lying at an intermediate angle area between yellow and magenta and a green ink lying between yellow and cyan to widen the color range that can be reproduced.

SUMMARY OF THE INVENTION

When multiple kinds of inks are used for improved image quality, as described above, ejection portions corresponding to the multiple colors are provided. In this case, if a single cap is made to cover the whole ejection portions for the recovery operation, the suction-based recovery operation is executed uniformly for all the ejection portions, consuming ink more than necessary.

Let us consider a configuration in which a print head and an ink tank are separably combined to allow for ink tank replacement and in which the suction-based recovery operation is performed after the ink tank is replaced. In this case, each time an ink tank of one color is replaced, the ink suction is also performed on those ejection portions that correspond to other color inks for which the associated ink tanks have not been replaced. As a result, inks of other colors are wasted. This problem becomes more salient as the number of kinds of inks increases. This configuration therefore is not advantageous when a number of different ink colors are used as in the above case.

To cope with this problem, the inventors of this invention have introduced a suction cap construction in which a plurality of ejection portions are divided into groups, each of which includes one or more ejection portions and can undergo the suction-based recovery operation independently of other groups. This suction cap construction is intended to allow the suction-based recovery operation to be executed at an optimum timing for each ejection portion that is determined by the way the user prints, such as a content of image to be printed and a print mode. With this arrangement, the wasteful ink consumption can be reduced which would otherwise be caused by a single-mode recovery operation performed uniformly for all ejection portions after the ink tank replacement and by an execution of the suction-based recovery operation at too early a timing. Not only can this arrangement reduce the overall consumption of ink but it can also prevent an increase in the size of a waste ink holding member and therefore the printing apparatus itself.

However, if the number of ejection portions included in each group and the configuration of the ink supply system leading to the associated ink tank (piping length and route) differ among the different groups, the ink flow resistance caused by an external pressure variation (due to the action of suction) changes from one ink supply system to another As a result, the negative pressure and the ink flow to achieve an optimum suction for each ejection portion do not match among the groups.

In the apparatus in which the above grouping is made so that the cap and ink discharge tube are provided for each group, if the suction pump is shared from the standpoint of reducing the size of the apparatus, the negative pressure and the ink flow produced by a predetermined quantity of pump drive are essentially equal in all caps or discharge tubes. Therefore, to generate an optimum negative pressure and ink flow for each group or for the ejection portions included in each group requires changing the pump driving condition to make it optimum for a particular ejection portion, executing the suction-based recovery operation for that particular ejection portion and repeating this process successively for the remaining ejection portions. This means that the time taken by the suction-based recovery operation increases with the number of ink kinds or ejection portions. During that recovery operation the printing operation has to be halted, lowering the printing throughput and giving unwanted stresses to the user.

To solve these problems, the present invention provides an ink jet printing apparatus capable of performing a recovery operation by sucking out ink from a plurality of ink ejection portions, the ink jet printing apparatus comprising: a suction means common to the plurality of ink ejection portions; and a means interposed between the plurality of ink ejection portions and the suction means in such a way that the suction operation can be performed on each group of one or more of the ink ejection portions, the means being adapted to generate different suction flows for different groups when the recovery operation is performed.

With this invention, a plurality of ejection portions are divided into groups so that each group includes one or more ejection portions and that the suction operation can be performed individually for each group. When the suction-based recovery operation is performed, this invention makes an arrangement to produce different ink flows for different groups during the suction operation so that the ink supply systems leading to the plurality of ejection portions can have essentially equal ink flows. As a result, simultaneous suction-based recovery operations on all ejection portions can be performed in a suitable condition. This in turn ensures an effective recovery operation, reducing the suction time to a minimum required, eliminating unwanted stresses on the user.

The above and other objects, effects, features and advantages of the present invention will become more apparent from the following description of embodiments thereof taken in conjunction with the accompanying drawings.

DETAILED DESCRIPTION OF PREFERRED EMBODIMENTS

Now, referring to the accompanying drawings, an embodiment of this invention will be described in detail.

(Mechanical Construction of Ink Jet Printing Apparatus)

Figure 1A:
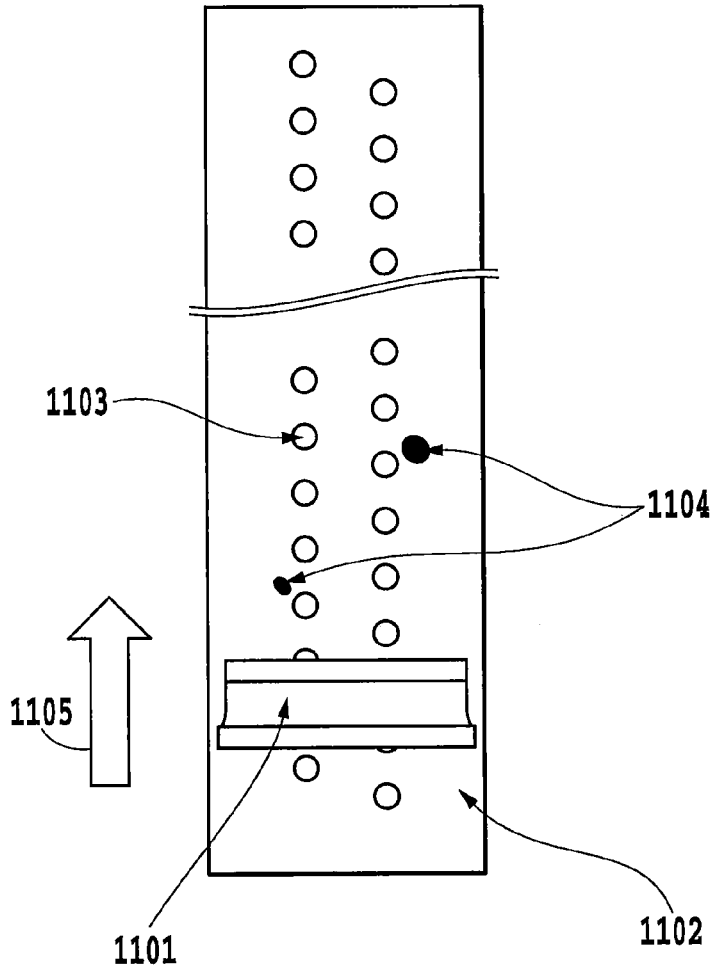
FIGS. 1A and 1B illustrate how a wiping operation is performed on a print head of an ink jet printing apparatus for maintenance.
Figure 1B:
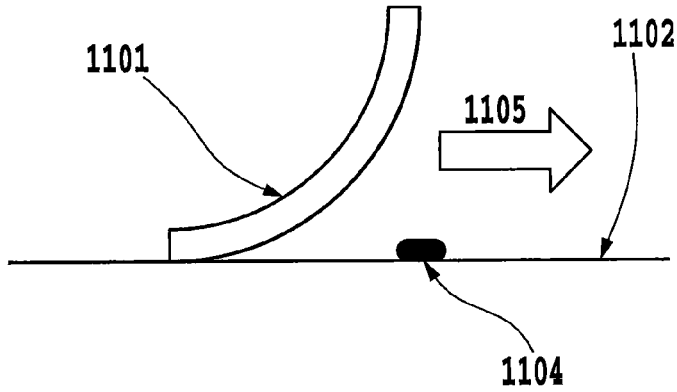
Figure 2:
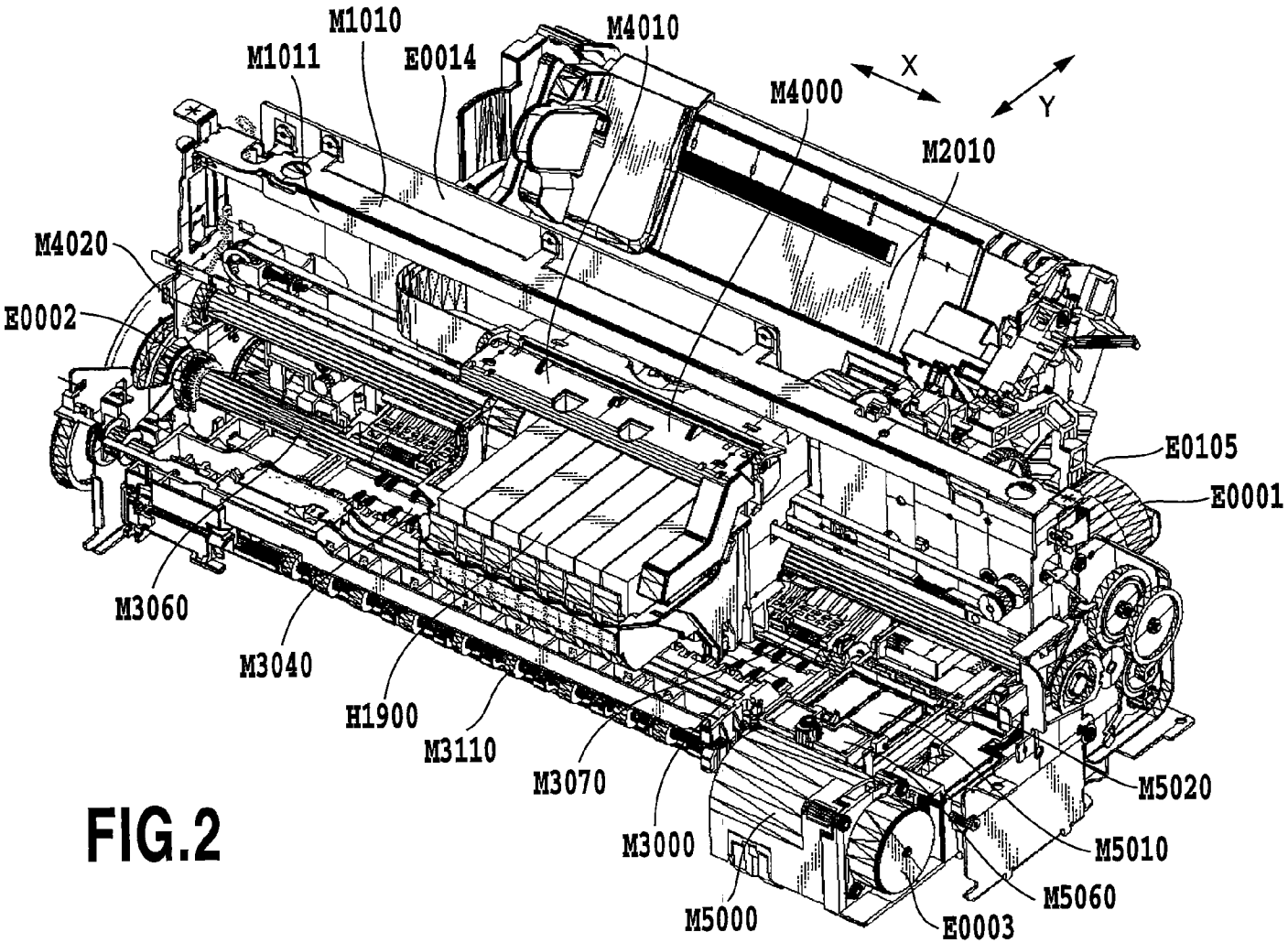
FIG. 2 is a perspective view showing a mechanism portion of the printing apparatus according to one embodiment of this invention.

FIG. 2 is a perspective view showing an ink jet printing apparatus of this embodiment, with its enclosure removed to expose its internal mechanism. The printing apparatus body of this embodiment may be classified by function into a paper supply unit, a paper transport unit, a paper discharge unit, a carriage unit, a cleaning unit and an enclosure unit. Since this invention concerns mainly the suction-based recovery operation, our explanation focuses mainly on the construction of the cleaning unit.

Cleaning Unit

The cleaning unit comprises a suction-based recovery unit, which includes a pump M5000 for cleaning a print head (described later) and a cap M5010 for keeping the print head from drying, and a wiping unit including a blade M5020 for cleaning an ejection face of the print head.

The cleaning unit is provided with a dedicated cleaning motor E0003. The cleaning motor E0003 has a one-way clutch (not shown), which enables the motor to drive the pump when the motor rotates in one direction and, when the motor rotates in the opposite direction, enables the motor to raise or lower the cap M5010 to close or open the ejection face of the print head and subsequently to move the blade M5020 to wipe clean the ejection face of the print head.

Although its detailed construction is described later by referring to FIG. 6 and FIG. 7, the pump M5000 activated by the cleaning motor E0003 has a tube pump construction in which a pump roller squeezes the ink discharge tube connected to the cap M5010 to generate a negative pressure in the cap. That is, with the cap M5010 kept in hermetic contact with the ejection face of the print head, activating the pump M5000 causes ink to be sucked out from the ejection openings of the print head.

Inside the cap M5010 an absorbent M5011 is placed to reduce the amount of ink remaining on the ejection face of the print head after being sucked out of the nozzles. To remove the ink that was sucked out into the cap M5010 and to prevent the ink from solidifying and thereby prevent the associated problems, the pump M5000 is operated with the cap M5010 open to the atmosphere to draw the residual ink out of the cap M5010 by suction. The ink drawn out by the pump M5000 is absorbed as waste ink in a waste ink absorbent (not shown) provided at an appropriate location, such as at a bottom or back of the apparatus, where it is retained.

When the cap M5010 Is lowered to part from the ejection face of the print head, the blade M5020 is moved through an open space directly below the ejection face in a direction perpendicular to the scan direction of the carriage M4000 to wipe clean the ejection face of the print head. A plurality of blades M5020 are provided which include one for cleaning the nozzles and the surrounding area of the print head H1001 and one for cleaning the entire ejection face. When the carriage M4000 reaches the farthest end of the stroke, it engages a blade cleaner M5060 by which the blade M5020 itself is removed of the adhering ink.

Other Mechanisms

The paper supply unit has a mechanism to separate one sheet at a time from the print medium stacked on a pressure plate 2010. The paper transport unit has a transport roller M3060 and a pinch roller M3070 that together hold and carry the supplied print medium toward a printing area, a transport motor E0002 for driving the transport roller and pinch roller, and a platen M3040 that supports the print medium in the printing area. The paper discharge unit has a discharge roller M3110 to discharge the printed medium from the printing area and a plurality of spur rollers that cooperate with the discharge roller.

The carriage unit has a carriage M4000 on which to mount a print medium. The carriage M4000 is supported by a guide shaft M4020 and a guide rail M1011, the guide shaft M4020 guiding and supporting the carriage M4000 so that the carriage M4000 can reciprocally travel in a direction perpendicular to the transport direction of the print medium. The carriage M4000 is driven by a carriage motor E0001 mounted on a chassis M1010 through a timing belt M4041.

In the above construction, when an image is formed on a print medium, a roller pair consisting of the transport roller M3060 and the pinch roller M3070 transports and positions the print medium with respect to the transport direction (or row direction). As to a position in the main scan direction (or column direction), the carriage motor E0001 moves the carriage M4000 in a direction perpendicular to the transport direction to locate the print head at a desired image forming position. The print head thus positioned ejects ink onto the print medium in response to a signal from an electric control board E0014. Although the detailed construction of the print head and the print system will be described later, the printing apparatus of this embodiment forms an image on the print medium by alternating a printing main scan, in which the print head prints as the carriage M4000 scans in the main scan direction, and a sub-scan in which the print medium is transported by the transport roller M3060 in the transport direction.

Print Head

Next, the construction of a head cartridge H1000 applied to this embodiment will be described. The head cartridge H1000 in this embodiment has means for mounting a print head H1001 and an ink tank H1900 and means for supplying ink from the ink tank H1900 to the print head. The head cartridge H1000 is removably mounted on the carriage M4000.

Figure 3:
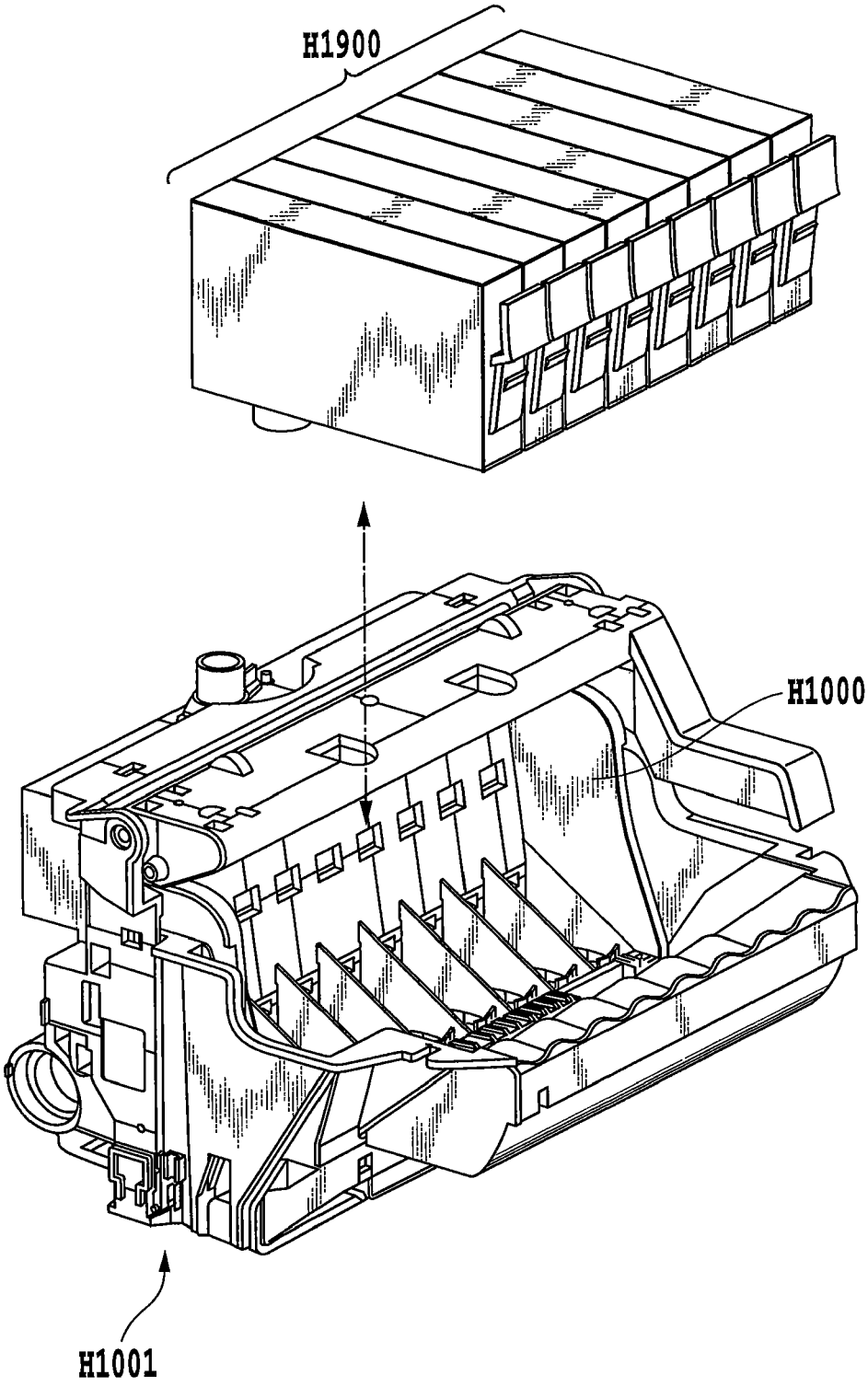
FIG. 3 is a perspective view showing an ink tank being mounted on a head cartridge applied to one embodiment of this invention.

FIG. 3 shows how the ink tank H1900 is mounted on the head cartridge H1000 applied in this embodiment. The printing apparatus of this embodiment forms an image using eight color inks and therefore eight independent ink tanks H1900 are provided for eight colors. Then, as shown in the figure, each of the ink tanks is removably mounted on the head cartridge H1000. The removing of the ink tanks H1900 can be done with the head cartridge H1000 put on the carriage M4000.

Figure 4:
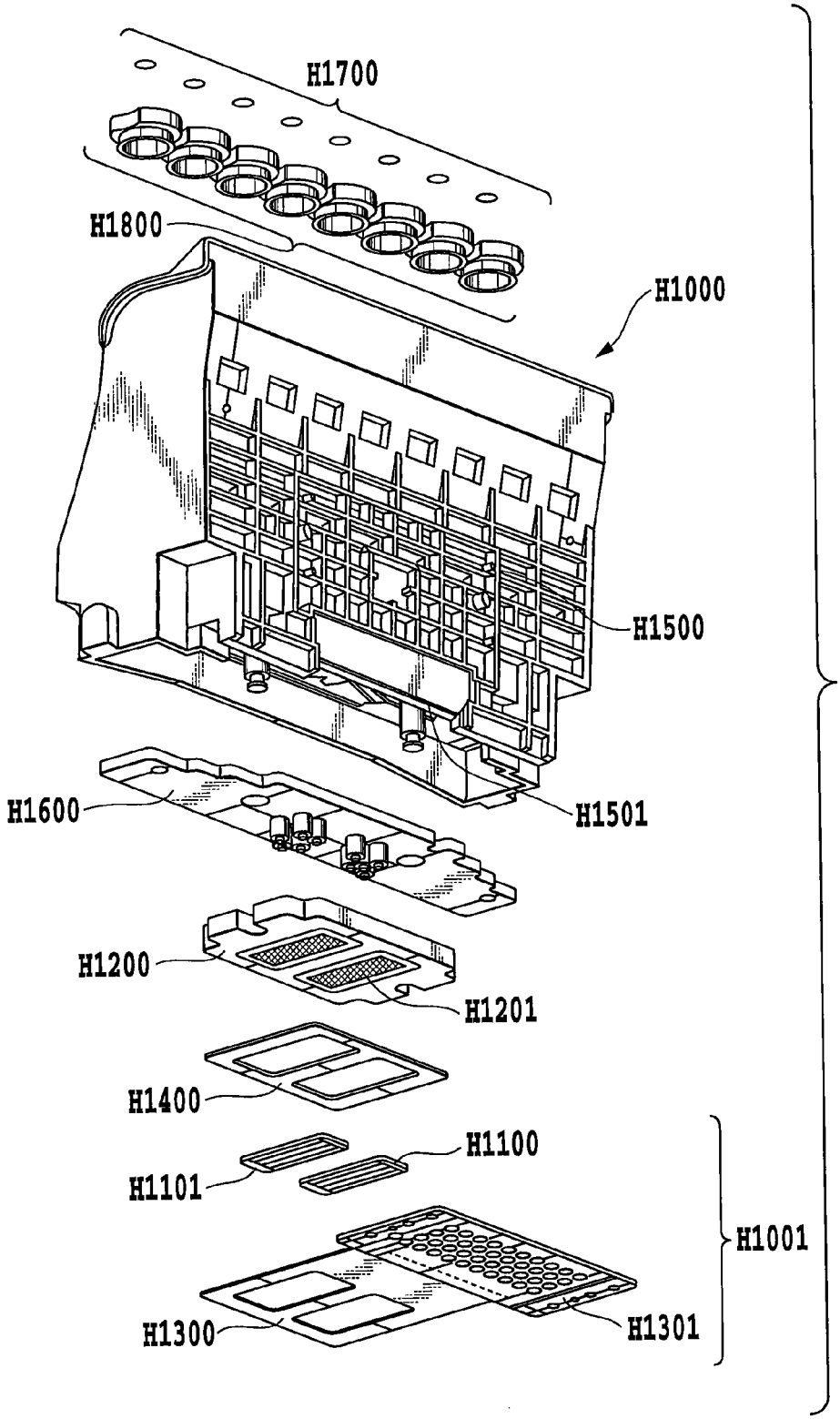
FIG. 4 is an exploded perspective view of the head cartridge applied to one embodiment of this invention.

FIG. 4 is an exploded perspective view of the head cartridge H1000. In the figure, the head cartridge H1000 comprises a first nozzle substrate H1100 and a second nozzle substrate H1101, a first plate H1200, a second plate H1400, an electric wiring board H1300, a tank holder H1500, a flow path forming member H1600, a filter H1700, and a silicone rubber H1800.

The first nozzle substrate H1100 and the second nozzle substrate H1101 are silicon substrates each of which is formed on one surface with a plurality of ink ejection nozzles by a photolithography technique. Electric wires for supplying electricity to the nozzles, such as aluminum wires, are formed by a deposition technique The ink paths connected to individual nozzles are also formed by the photolithography. Further, each of the first and second nozzle substrates is formed on the back with an ink supply port to supply ink to the individual ink paths.

A column of nozzles (or nozzle column) for each of different ink colors is made up of 768 nozzles arranged at intervals of 1200 dpi (dots/inch) in the print medium transport direction, each of which ejects ink droplets of about 2 pico-liters. An opening area of each nozzle is set to about 100 $\mu m^2$. The first nozzle substrate H1100 and the second nozzle substrate H1101 are securely bonded to the first plate H1200 which is formed with ink supply ports H1201 to supply ink to the first nozzle substrate H1100 and the second nozzle substrate H1111.

Further, the first plate H1200 is securely bonded with the second plate H1400 having openings, which has the electric wiring board H1300 electrically connected with the first nozzle substrate H1100 and the second nozzle substrate H1101.

The electric wiring board H1300 applies an electric signal to the associated nozzles formed in the first nozzle substrate H1100 and the second nozzle substrate H1101 to eject ink from the individual nozzles. The electric wiring board H1300 comprises electric wires connected to the first nozzle substrate H1100 and the second nozzle substrate H1101 and an external signal input terminal H1301 situated at an end portion of the electric wiring board H1300 to receive an electric signal from the printing apparatus body. The external signal input terminal H1301 is positioned and secured on the back side of the tank holder H1500.

The tank holder H1500 holding the ink tank H1900 has the flow path forming member H1600 secured thereto as by ultrasonic fusing to form an ink path H1501 running from the ink tank H1900 to the first plate H1200.

At the end of the ink path H1501 on the ink tank side that engages the ink tank H1900, a filter H1700 is provided to prevent ingress of dust from outside. The engagement portion of the filter with the ink tank H1900 is attached with a seal rubber H1800 to prevent ink evaporation.

Further, the tank holder unit made up of the tank holder H1500, the flow path forming member H1600, the filter H1700 and the seal rubber H1800 is combined, as by bonding, with the print head H1001 made up of the first nozzle substrate H1100, the second nozzle substrate H1101, the first plate H1200, the electric wiring board H1300 and the second plate H1400 to construct the head cartridge H1000.

Figure 5:
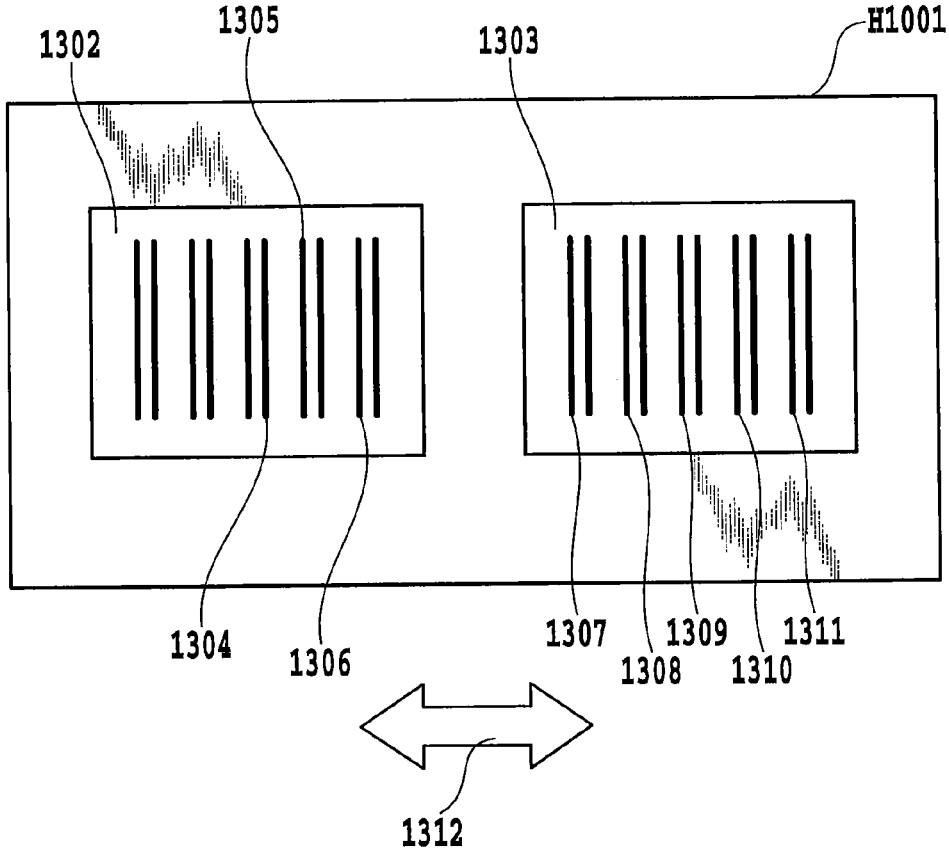
FIG. 5 is a schematic diagram showing a construction of the print head used in the head cartridge of FIG. 4 in which a print head unit featuring a fast full-color printing and a print head unit featuring a high quality printing are separated.

FIG. 5 shows an arrangement of nozzle groups in the print head in a first embodiment of this invention. Here, reference number 1302 corresponds to the first nozzle substrate H1100, a print head unit featuring a high-speed full color printing. Reference number 1303 corresponds to the second nozzle substrate H1101, a print head unit featuring a high quality printing.

The print head unit 1302 characterized by the fast full color printing has ejection portions 1304, 1305, 1306 to eject yellow, magenta and cyan inks—three primary colors of colorants—to reproduce full color by the subtractive color mixing. Each of the ejection portions has a nozzle column with nozzles arranged in a direction different from the scan direction 1312 of the print head H1001 (e.g., in the transport direction of a print medium crossing the scan direction almost at right angles) and has two nozzle columns for each color. These two nozzle columns are shifted from each other by one-half pitch of the nozzles in the transport direction. In the figure, two ejection portions (each having two columns) shown to the left of the ejection portion 1304 are not used in this embodiment.

The print head unit 1303 characterized by the high quality printing has ejection portions 1307, 1311 to eject a light cyan ink and a light magenta ink to enhance the color tone of an output image, and an ejection portion 1309 to eject a black ink to enhance a contrast of the output image. Further, in this embodiment, to make it possible to reproduce a color range that cannot be reproduced by the primary colors alone—cyan, magenta and yellow—ejection portions 1308, 1310 to eject two special inks (special ink 1 and special ink 2) are provided. In the print head unit 1303 too, each of the ejection portions 1307-1311 is made up of two nozzle columns, as with the print head unit 1302.

Suction-Based Recovery Unit

Figure 6:
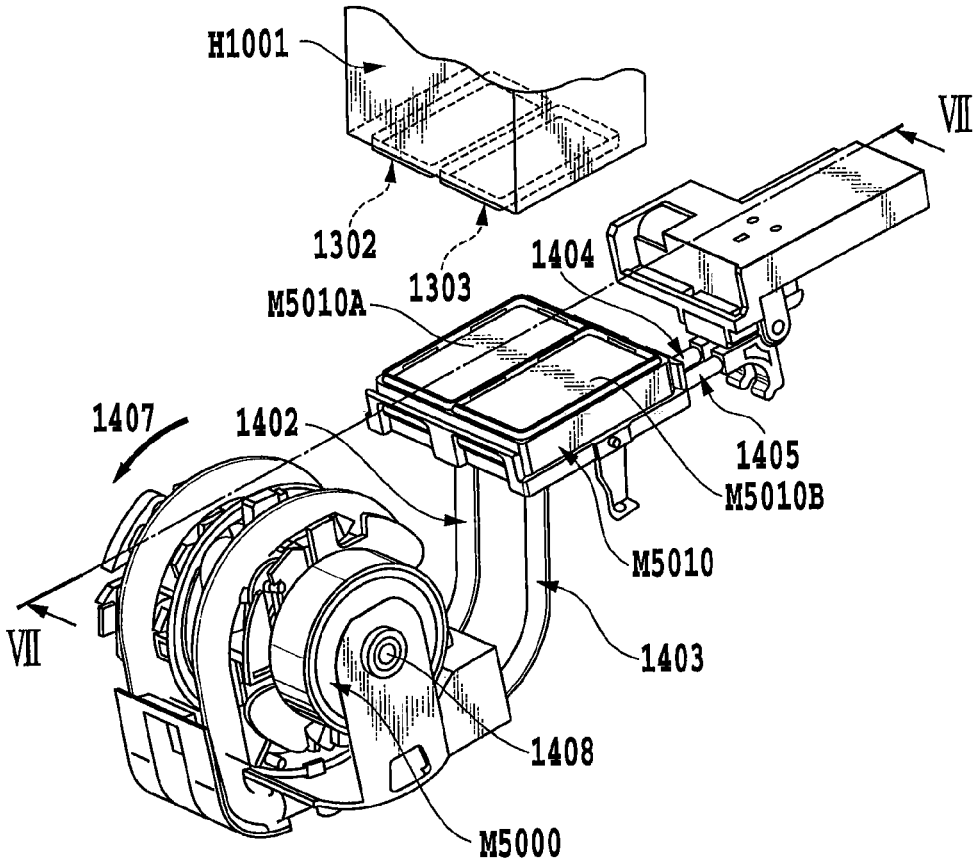
FIG. 6 is a perspective view of a suction-based recovery unit making up a cleaning unit of FIG. 2.
Figure 7:
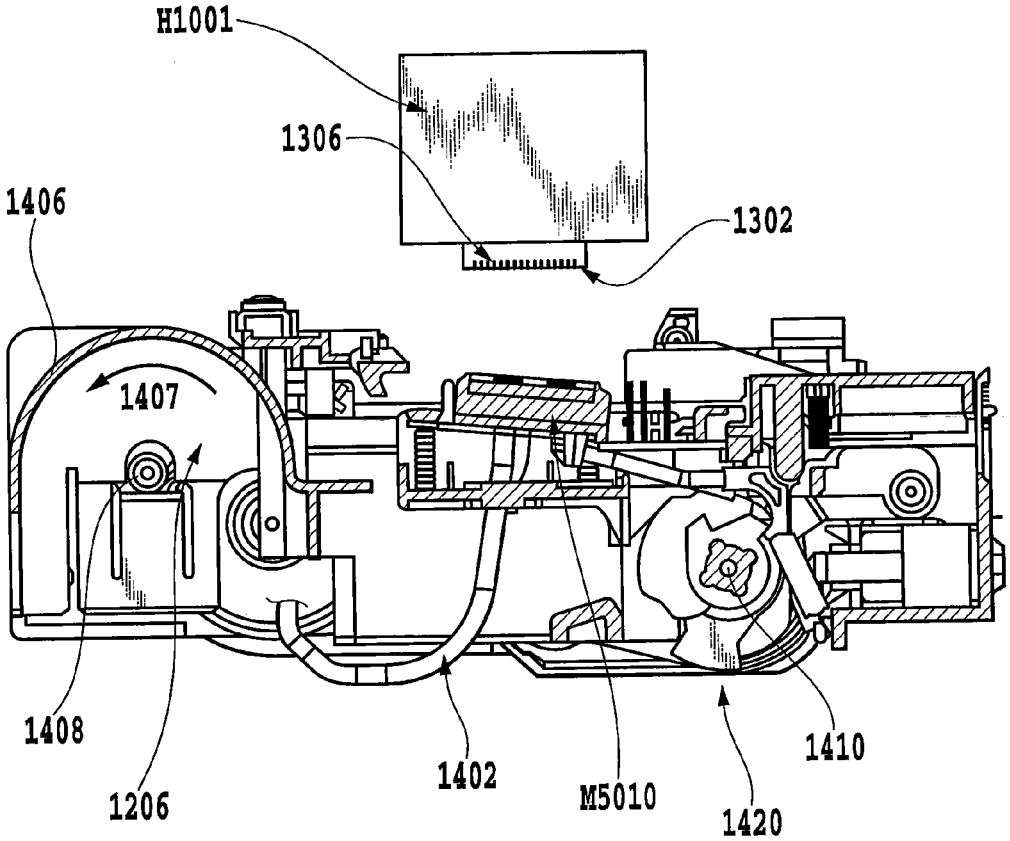
FIG. 7 is a cross-sectional view taken along the line VII-VII of FIG. 6, showing the suction-based recovery unit and its associated components.

FIG. 6 is a perspective view of the suction-based recovery unit and FIG. 7 is a cross-sectional view taken along the line VII-VII of FIG. 6 including the suction-based recovery unit. A cap M5010 forming the suction-based recovery unit of this embodiment is made up of two cap portions M5010, M5010B that can be brought into contact with or pressed against the ejection surface of the print head unit 1302 having the ejection portions 1304-1306 and the ejection surface of the print head unit 1303 having the ejection portions 1307-1311. Further, the cap units M5010A, M5010B are provided with atmosphere opening valves 1404, 1405 respectively, which can individually open the spaces inside the cap units to, and close them from, the open air. The cap units M5010A, M5010B are connected with flexible ink discharge tubes 1402, 1403.

The suction-based recovery unit of this embodiment uses a tube pump as the suction pump M5000 that creates a negative pressure to suck out ink. The tube pump comprises a member 1406 having a curved surface along which to hold the elongate portions of the flexible ink discharge tubes 1402, 1403; a roller (not shown) capable of pressing the elongate portions of the tubes 1402, 1403 against the curved surface; and a roller support (not shown) rotatable about a rotary shaft 1408 in a direction indicated by arrow 1407. That is, rotating the roller support in the direction of arrow 1407 causes the roller to squeeze the tubes 1402, 1403 on the curved surface of the member 1406 as it rotates. This in turn creates a negative pressure in the closed spaces formed by the cap units M5010A, M5010B, drawing out ink by suction from the ejection openings of the nozzles for each color into the tubes 1402, 1403. Then, the ink thus drawn out is further drawn from the end of each tube toward an appropriate member (such as a waste ink holding member).

Here, if the suction pump is provided independently for each of the ink discharge tubes 402, 1403, the suction-based recovery unit would become large in volume, increasing the size of the printing apparatus and therefore the cost. In this embodiment, therefore, a single suction pump M5000 is provided for two ink discharge tubes 1402, 1403, as described above, and is driven by the motor E0003 as a single drive source. That is, while the cap units M5010A, M5010B, the atmosphere opening valves 1404, 1405 and the ink discharge tubes 1402, 1403 are provided independently for each of the print head units 1302, 1303, the suction pump M5000 is used commonly.

The suction-based recovery operation is performed as follows. The cap units M5010A, M5010B are simultaneously capped onto the print head units 1302, 1303 and at the same time only the atmosphere opening valve provided at the cap unit corresponding to the print head unit on which one wishes to perform the suction-based recovery operation is closed and the atmosphere opening valve provided at the cap unit corresponding to the print head unit that does not require the suction-based recovery operation is opened. With this operation the desired print head unit can be chosen for the suction-based recovery operation.

As described above, by capping the cap units M5010A, M5010B on the ejection surfaces of the print head units 1302, 1303 and operating the suction pump M5000, with the corresponding atmosphere opening valve closed, to suck out ink from the inside of the cap or from the nozzles of the print head unit 1302 and/or 1303, it is possible to keep the ink ejection from the print head units 1302, 1303 in good condition.

In this embodiment, the cap units M5010A, M5010B are formed integral with the cap M5010 to enable simultaneous capping of both the print head units 1302, 1303. Further, it is made possible to individually open and close the atmosphere opening valve 1404 corresponding to the print head unit 1302 and the atmosphere opening valve 1405 corresponding to the print head unit 1303, thus allowing for an independent suction-based recovery operation for each of the print head units. However, two separate caps may be used to cap the associated print head units 1302, 1303 individually.

The vertical movement of the cap M5010 and the operation of the blade M5020 can be controlled mechanically by a main cam 1420 which has a plurality of cams on a shaft 1410, as shown in FIG. 7. That is, cam surfaces at different locations act on a link mechanism such as arm to produce a predetermined operation. The rotary position of the main cam 1420 can be detected by a position sensor such as photo-interrupter.

(Configuration of Control System in Ink Jet Printing Apparatus)

Next, the configuration of a control system in this embodiment, i.e., a control circuit and its operation, will be explained.

Control Circuit

Figure 8:
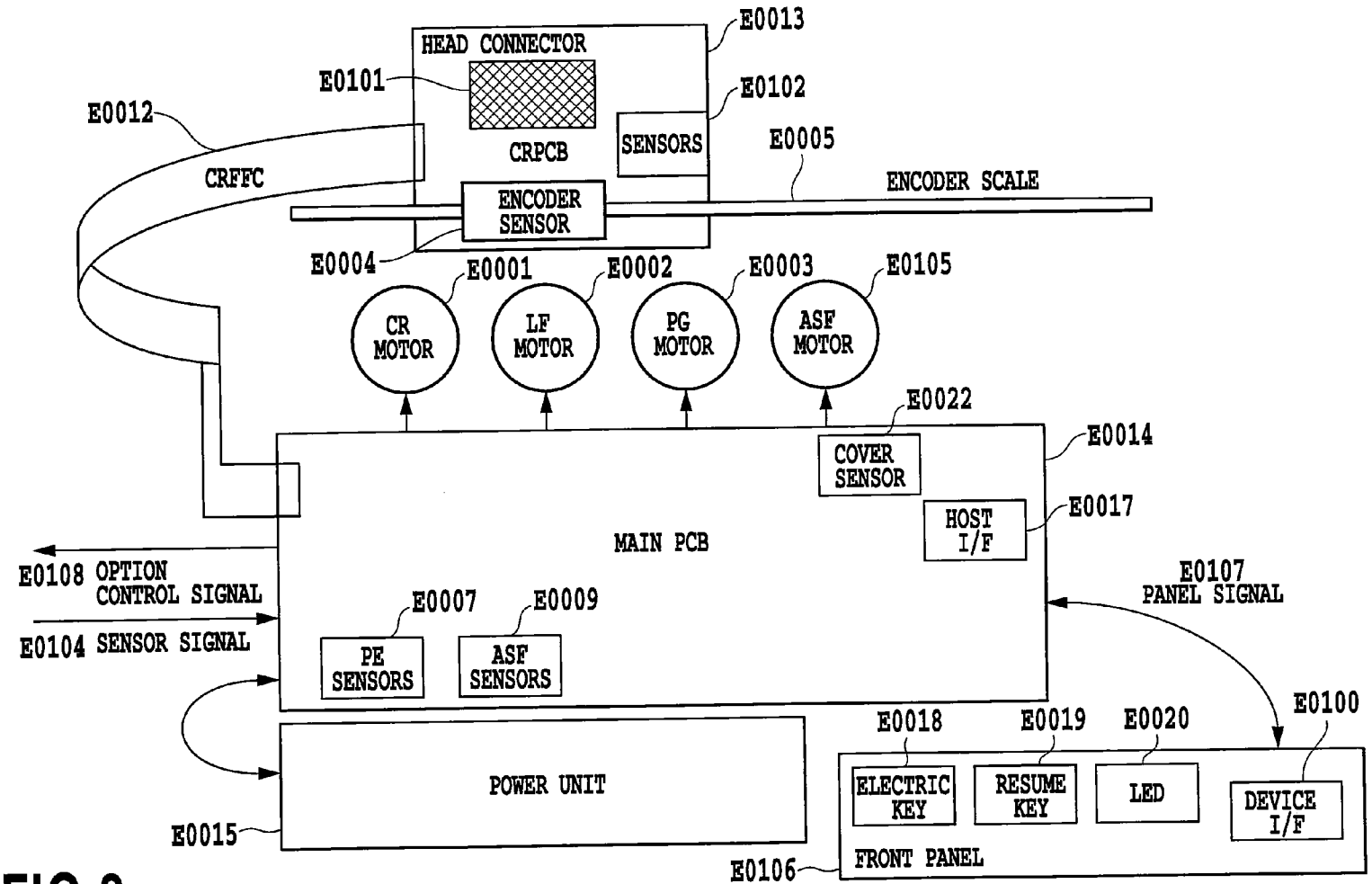
FIG. 8 is a block diagram schematically showing an overall configuration of a control system in the printing apparatus of FIG. 2.

FIG. 8 is a block diagram schematically showing an overall configuration of the control circuit in one embodiment of this invention.

The printing apparatus of this embodiment comprises mainly a printed circuit board for a carriage (CRPCB) E0013, a main PCB E0014, a power supply unit E0015 and a front panel E0106. The power supply unit E0015 is connected to the main PCB E0014 to supply a variety of driving power.

The CRPCB E0013 is a printed circuit board unit mounted on the carriage M4000 and functions as an interface to transfer signals to and from the print head H1010 through a head connector E0101. According to a pulse signal output from an encoder sensor E0004 as the carriage M4000 moves, the CRPCB E0013 detects a change in positional relation between an encoder scale E0005 and an encoder sensor E0004 and outputs its signal to the main PCB E0014 through a flexible flat cable (CRFFC) E0012. The CRPCB E0013 has sensors E0102 including a temperature sensor such as thermistor to detect an ambient temperature and an optical sensor. Information obtained from these sensors E0102 is output to the main PCB E0014 through the flexible flat cable E0012 together with the head temperature information from a temperature sensor (not shown) provided in the print head cartridge H1000.

The main PCB E0014 is a printed circuit board unit that governs an operation and control of various parts in the ink jet printing apparatus of this embodiment. On the printed circuit board are mounted a CPU that performs a variety of controls including the suction-based recovery operation control to be described by referring to FIG. 9, and a ROM storing a program to be executed by the CPU. The main PCB E0014 also has a paper end (PE) sensor E0007, an automatic sheet feeder (ASF) sensor E0009, a cover sensor E0022 and a host interface (host I/F) E0017. The main PCB is also connected with various motors, such as a carriage motor E0001 that drives the carriage M4000 for main scan, an LF motor E0002 to carry a print medium, a motor E0003 as a drive source for a recovery operation of the print head H1001, and an ASF motor E0105 as a drive source for the print medium supply operation. Further, the main PCB receives various sensor signals E0104 representing the mounting condition and operation state of option units, such as ink empty sensor, media (paper) sensor, carriage position (height) sensor, LF encoder sensor and PG sensor. The main PCB also outputs an option control signal E0108 for controlling the operation of the option units. Further, the main PCB E0014 is connected with the CRFFC E0012, the power supply unit E0015 and the front panel E0106 and has an interface to transfer information by a panel signal E0107.

For ease of user operation, the front panel E0106 is provided on the front of the printing apparatus body and has a resume key E0019, an LED E0020, a power key E0018 and a device I/F E0100 for connection with peripheral devices such as digital camera.

Sequence of Suction-Based Recovery Operation

Figure 9:
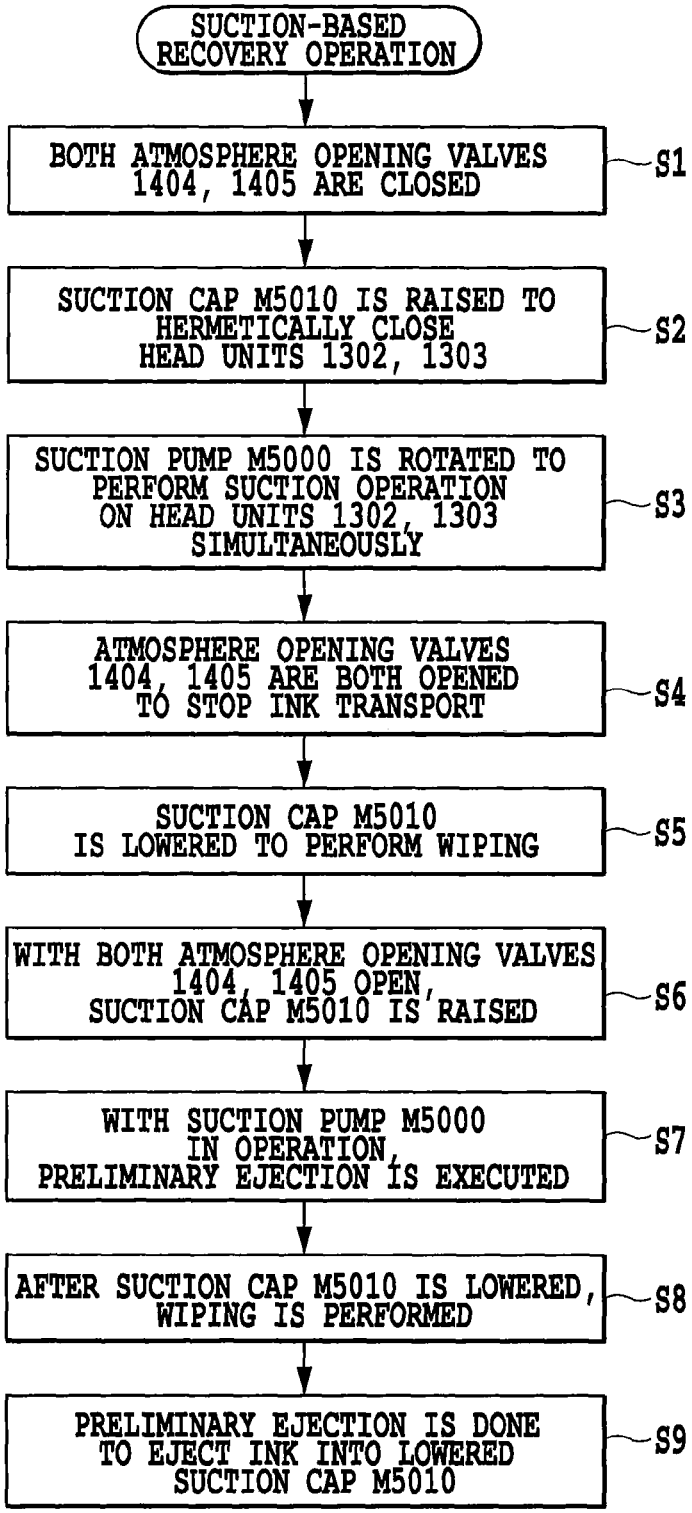
FIG. 9 is a flow chart showing an example sequence of the suction-based recovery operation performed in one embodiment of this invention.

FIG. 9 shows, among various controls executed in the above configuration, an example control sequence in performing the suction-based recovery operation on the print head units 1302, 1303, which constitutes a main part of this embodiment.

First, with the carriage M4000 set so that the print head units 1302, 1303 oppose the cap units M5010A, M5010B respectively, the atmosphere opening valves 1404, 1405 of the cap units M5010A, M5010B are both closed (step S1). Next, the cap M5010 is raised to press the cap units M5010A, M5010B against the print head units 1302, 1303 to cap their ejection faces (step S2). With these steps taken, the print head units 1302, 1303 are both hermetically closed.

Next, the suction pump M5000 connected to the two ink discharge tubes 1402, 1403 is operated to perform the suction-based recovery operation on the print head units 1302, 1303 (step S3). If at this time the atmosphere opening valves are left open, external air is drawn in through the atmosphere opening valves, nullifying the suction-based recovery operation. The revolution of the suction pump can be changed according to the purpose of the maintenance (the volume of ink to be discharged from the print head H1001).

Next, when the predetermined suction-based recovery operation is finished, the atmosphere opening valves 1404, 1405 are opened to admit air into the cap units M5010A. M5010B that hermetically closed the print head units 1302, 1303, thereby stopping the ink from moving in the print head H1001 (step S4).

Next, with the cap M5010 lowered, the blade M5020 is moved to perform a wiping operation to wipe residual ink droplets off the ejection surfaces of the print head units 1302, 1303 (step S5). Next, with the atmosphere opening valves 1404, 1405 left open, the cap M5010 is raised (step S6). Then, with the cap units M5010A, M5010B engaging the print head units 1302, 1303, respectively, the suction pump M5000 is operated to cause both of the print head units 1302, 1303 to perform the preliminary ejection (step S7). The operation in step S7 is intended to prevent a possible contamination of the interior of the printing apparatus which would otherwise be caused by ink mist moving into the apparatus during the preliminary ejection.

Next, the cap M5010 is lowered again, followed by a wiping operation to clear residual ink droplets from the ejection surfaces of the print head units 1302, 1303 (step S8). Then, a preliminary ejection is performed to eject ink into the lowered cap M5010 (step S9), thus completing a series of operations associated with the suction-based recovery.

Performing the above operations enables both of the print head units 1302, 1303 to be processed simultaneously by the suction-based recovery operation. It is also possible to operate the suction pump M5000 after step S9 to control the suction-based operation to discharge ink from inside the cap M5010.

If one wishes to perform the suction-based recovery operation individually on the print head unit 1302 and 1303, one of the atmosphere opening valves 1404, 1405 needs to be closed before proceeding to the above-mentioned sequence of operations.

Whether the suction-based recovery operation should be performed on the print head units 1302, 1303 either simultaneously or individually can be chosen appropriately. For example, prior to initiating the suction-based recovery operation, a predetermined preliminary ejection may be performed using the print head units or each color ejection portion and temperature rise characteristics may be measured. If no temperature rise in excess of a predetermined threshold is detected in any print head unit or color ink ejection portion, it is decided that there exists no trapped air or bubble in the ink supply path that would block a smooth ink supply. The suction-based recovery operation therefore may be performed simultaneously on both the print head units 1302, 1303. On the other hand, if a temperature rise in excess of the predetermined threshold is detected in one of the print head units or one of the color ink ejection portions, or when an ink tank of a certain color is replaced, the suction-based recovery operation may be performed concentratedly only on the print head unit in question.

As described above, in this embodiment, the print head unit 1302 featuring the fast full color printing and the print head unit 1303 featuring the high quality printing are separated in the print head H1001 so that these print head units can be processed by the suction-based recovery operation independently of each other. This enables the suction-based recovery operation to be performed only on the print head unit that needs it, reducing the number of color inks used in the recovery operation or the number of ejection portions undergoing the recovery operation from that of full eight colors down to that of five or three colors. This in turn reduces the amount of ink consumed during the suction-based recovery operation.

(Design of Suction-Based Recovery Unit)

The following description concerns a construction that enables an appropriate suction-based recovery operation to be performed either simultaneously or separately on the print head units 1302, 1303.

Figure 10:
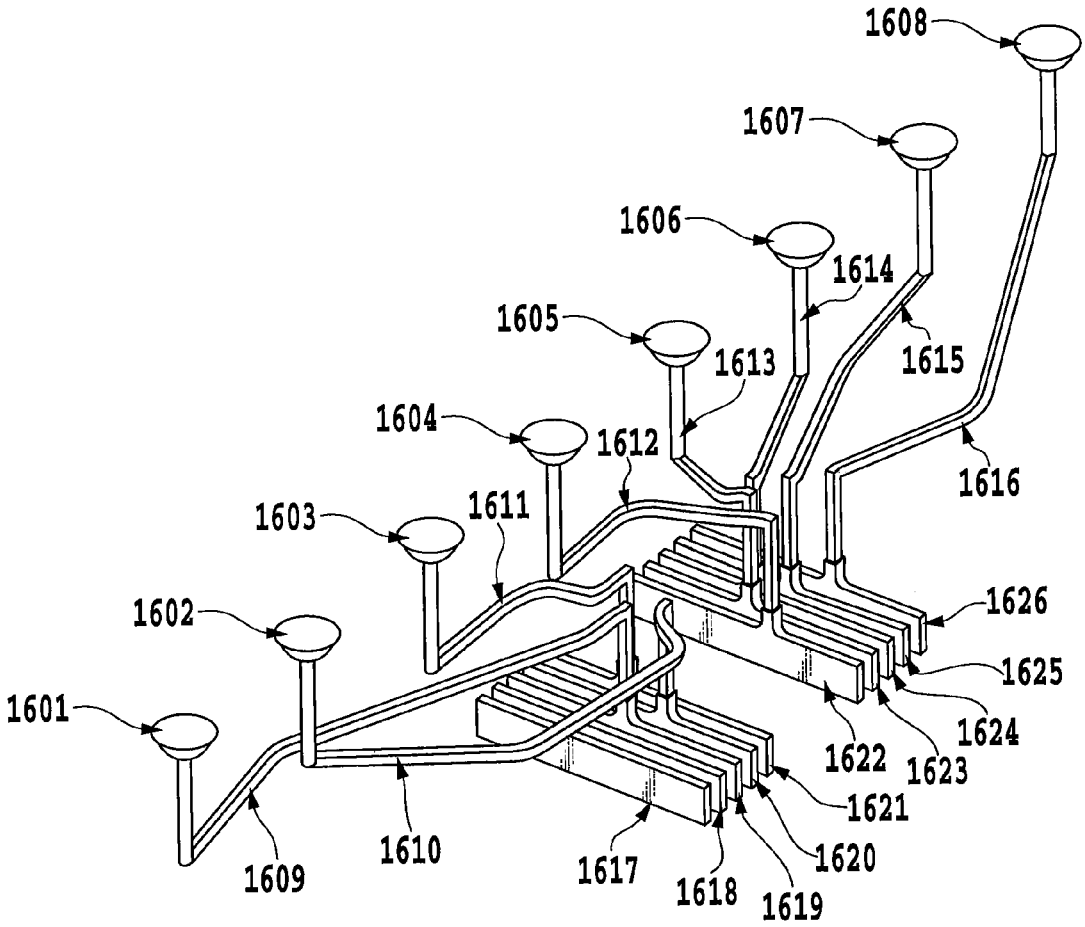
FIG. 10 illustrates an outline of an ink supply system from an ink tank to nozzles in one embodiment of this invention.

FIG. 10 schematically shows an ink supply system running from ink tanks to ink ejection nozzles.

Denoted 1601-1608 in the figure are filters that are connected to the ink tank situated above That is, the filters 1601-1608 are connected to the ink tanks H1900 situated above that accommodate yellow ink, magenta ink, cyan ink, light cyan ink, special ink 1, black ink, special ink 2 and light magenta ink.

Portions indicated by 1609-1616 in the figure are supply paths to supply inks from individual ink tanks. Further, portions represented by reference numbers 1619-1626 are ink chambers to stably distribute and supply ink to the ejection portions 1304-1311 of the associated color inks and are equal in shape and dimension. Denoted 1617 and 1618 are also ink chambers that correspond to the two ejection portions which in FIG. 5 are shown to the right of the ejection portion 1306 and not used in this embodiment. These two ink chambers are not connected with ink pipes.

That is, the ink path for the print head unit (for cyan, magenta and yellow) 1302 featuring the fast full color printing is formed by the filters 1601-1603, the supply paths 1609-1611 and the ink chambers 1619-1621. The ink path for the print head unit (for black, light cyan, light magenta, special ink 1 and special ink 2) 1303 featuring the high quality printing is formed by the filters 1604-1608, the supply paths 1612-1616 and the ink chambers 1622-1626.

Here, in the first embodiment of this invention, how much ink flow should be generated in each of the ink discharge tubes 1402, 1403 according to the purpose of the suction-based recovery operation will be explained.

The suction-based recovery operation is performed to deal with the problem (c) described earlier That is, the suction-based recovery is performed when it is desired to remove bubbles lying in the ink paths, ink chambers and nozzles or to replace viscous ink near the ejection openings resulting from the evaporation of solvent with new ink. The suction-based recovery is also performed when the ink in the ink tank is consumed completely or when the ink supply paths and ink chambers are to be refilled with ink after the ink supply system is opened during the ink tank replacement.

In these cases, the ink flow in the ink supply path and the ink chamber is an important factor to be considered because too small an ink flow may result in a large air space remaining in the ink chamber during refilling and because bubbles present in the ink chamber hardly move and thus are not easily removed. On the other hand, too large an ink flow may result in outer air being drawn in from a joint between the ink tank H1900 and the print head H1001, undesirably increasing bubbles in the ink chamber.

In this embodiment in which there are no large differences in the size of the ink supply path and ink chamber between different systems, when each system is seen as an independent system, it can be assumed that a sufficient ink flow for the suction-based recovery operation is almost uniquely determined However, it must be noted in this embodiment that the print head unit 1302 featuring the high-speed full color printing has three systems of ink supply path and ink chamber, one for each of cyan, magenta and yellow, and that the print head unit 1303 featuring the high quality printing has five systems of ink supply path and ink chamber, one for each of black, light cyan, light magenta, special ink 1 and special ink 2. Therefore, the total ink flows that are considered sufficient in these print head units for the suction-based recovery operation differ.

In this embodiment therefore, when the suction-based recovery operation is performed on the print head unit 1302 by the suction pump M5000, the ink flow in the ink discharge tube 1402 is set to three times the ink flow required in one system. As for the suction-based recovery operation on the print head unit 1303, the ink flow in the ink discharge tube 1403 is set to five times the ink flow required in one system.

As described above, in order to produce ink flows three times and five times the ink flow required in one system when simultaneous suction-based recovery operations are performed by a single drive system, this embodiment differentiates effective cross-sectional areas or, more specifically, inner diameters of the ink discharge tubes 1402 and 1403 having circular cross-sections, thus generating different ink flows.

Now, how the diameters of the ink discharge tubes 1402, 1403 are determined in this embodiment will be explained.

Figure 11:
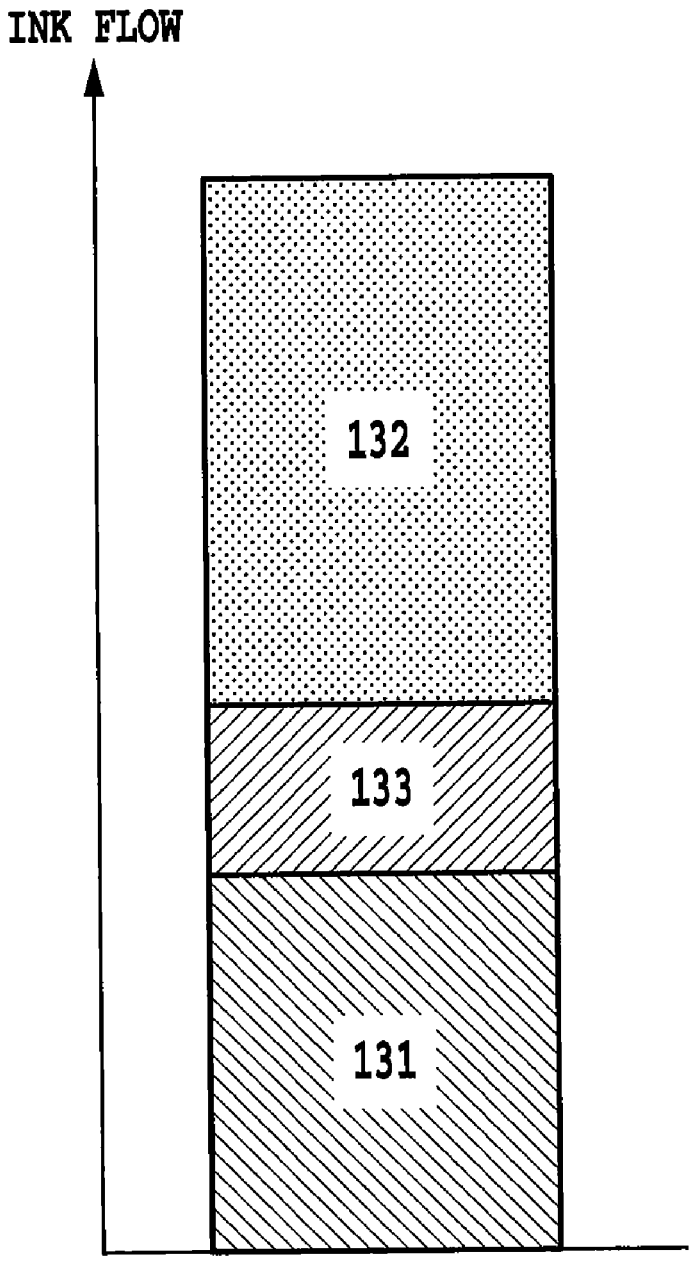
FIG. 11 is a conceptual diagram showing an ink flow generated by a pump in one ink supply system.

FIG. 11 conceptually shows an ink flow in one system generated by a pump.

An area 131 marked with inclined lines represents an area where the ink flow is too small to completely fill the ink chamber with ink. An area 132 marked with dots represents an area where the ink flow Is so large that external air is drawn in from a joint between the ink tank H1900 and the print head H1001, undesirably increasing bubbles in the ink chamber. An area 133 marked with inclined lines represents an area where an object can be suitably achieved without causing the above problems. Therefore, it is strongly desired that, in either of the print head units 1302 and 1303, an ink flow which falls in the range of the inclined-line area 133 be produced in each system during the suction-based recovery operation by each of the ink discharge tubes 1402, 1403.

In this embodiment, the Inner diameter of the tube 1403 on the print head unit 1303 having five systems of ink path and ink chamber is first set to 3.5 mm. Then, the drive quantity for the suction pump M5000 or the PG motor E0003 is determined to satisfy the condition that the ink flow in one system falls in the area 133. Then, using the same drive quantity, the inner diameter of the ink discharge tube 1402 is determined such that the ink flow in one system on the print head unit 1302 having three systems of ink path and ink chamber falls in the area 133.

Figure 12:
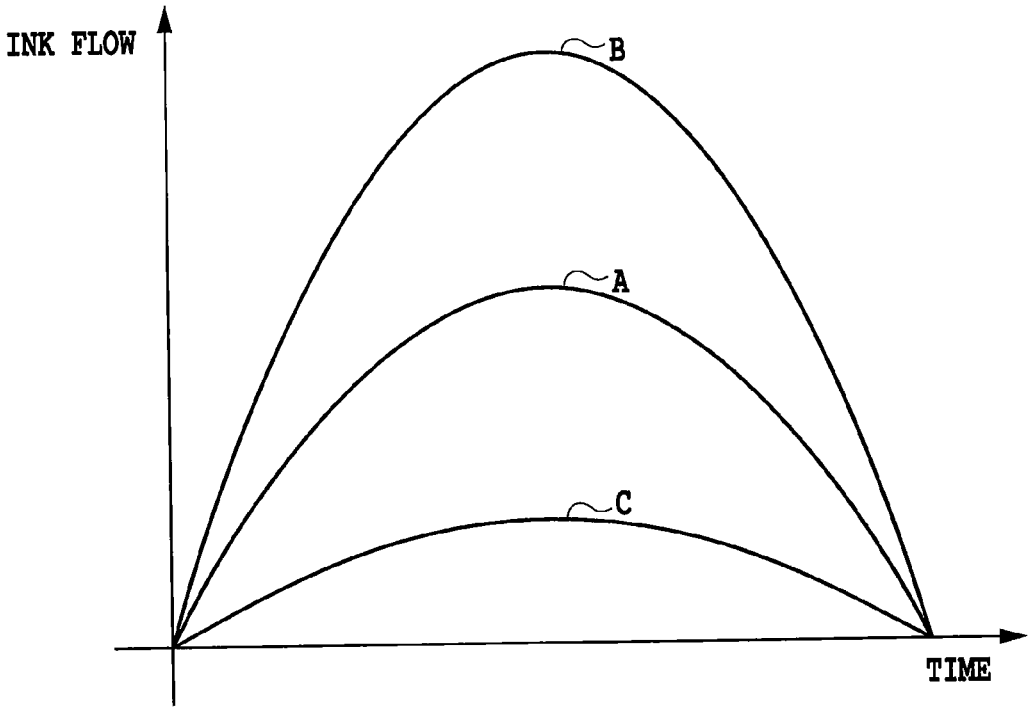
FIG. 12 is a diagram showing how an inner diameter of an ink discharge tube is determined to obtain an appropriate ink flow in each of the ink supply systems.

FIG. 12 is a conceptual diagram showing different ink flows produced in a single system for different inner diameters of tube when the recovery operation is executed on the print head unit having three systems by using the same drive quantity that was determined for the print head unit having five systems. A curve A represents a suction negative pressure waveform for a tube inner diameter of 3.0 mm, a curve B represents a waveform for the same tube inner diameter of 3.5 mm as that of the five-system side, and a curve C represents a waveform for a tube inner diameter of 2.5 mm.

For the curve B that was obtained when the tube was set to the same inner diameter of 3.5 mm as that of the five-system side, the ink flow produced on the five-system side was appropriate but too large on the three-system side, so that external air was drawn in from a joint between the ink tank and the print head, undesirably increasing bubbles in the ink chamber. For the curve C where the tube inner diameter was set to 2.5 mm, it was observed that the ink flow was too small to fill ink into the empty ink chamber. For the curve A where a tube 2.5 mm in inner diameter was used, the suction operation could be performed appropriately in any system without causing the above problems, Therefore, for the tube 1402 on the print head unit 1302 that features the high-speed full color printing and has three systems of ink path and ink chamber, a tube inner diameter of 3.0 mm was chosen.

Although the tube diameter on the print head unit 1302 having three systems has been determined here by taking the print head unit 1303 having five systems as a drive reference, the procedure may of course be reversed by taking the tube diameter on the print head unit 1302 having three systems as the drive reference and then determining the tube diameter on the print head unit 1303 having five-systems.

(Others)

In the ink set of the above embodiment, since inks of different colors contact or mix together in the cap or ink discharge tube, it is desired that a reaction does not occur. That is, it is desired that no reaction occurs in either one of ink sets, i.e., the ink set including yellow, magenta and cyan inks and the ink set including black, light cyan, light magenta, special 1 and special 2 inks. For this reason, this embodiment used dye-based inks for eight colors. However, if there is no adverse effect on the ink ejection performance and maintainability when different kinds of inks contact and mix together, both of the dye-based inks and pigment-based inks may be used. Further, there is no limitations on the color used. If a plurality of kinds of ink that do influence the ink ejection or maintenance characteristics are used, it is possible to classify those inks that do not react upon contact as one group and to form an ink discharge system for that group including a cap and ink discharge tube.

As for the number of ink discharge systems and the kinds (colors) and numbers of inks and ejection portions that correspond to one ink discharge system, there is no limitation and any appropriate selection can be made for size and cost reduction.

In an ink jet printing apparatus capable of performing a recovery operation by sucking out ink from a plurality of ejection portions using a common suction means, one or more ejection portions are gathered into groups so that ink can be sucked out from any group of ejection portions. An arrangement is made to produce different ink flows in different groups of ejection portions during the suction operation in order to ensure that, when the recovery operation is performed, substantially the same flow can be produced in each of a plurality of ink supply systems leading to the plurality of ejection portions.

In other words, when simultaneous suction-based recovery operations are performed in a conventional apparatus, desirable suction-based recovery operation cannot be achieved for all of a plurality of ink supply systems. This is because the conventional apparatus have an ink supply construction in which an ink flow resistance subjected to an external pressure variation may vary from one ink supply system to another. This occurs when the number of ejection portions or ink supply systems grouped together differ from another group (i.e., in a construction like the above-described embodiment, there are three ink supply systems on the print head unit 1302 and five ink supply systems on the print head unit 1303). In this invention, however, since different ink flows can be produced during the suction operation among different groups of ejection portions, substantially equal flows can be produced in each of the plurality of ink supply systems leading to the plurality of ejection portions. As a result, appropriate suction-based recovery operations can be performed simultaneously on all ejection portions under desirable conditions.

This invention is not limited to a configuration in which the number of ejection portions or ink supply systems grouped together differs from another group. The invention can be applied widely and effectively as long as the ink supply structure is such that different ejection portions have different number of nozzles or different nozzle diameters, that the structures of the plurality of ink supply systems differ, or that different ejection portions exhibit different ink flow resistances when subjected to external pressure variations.

In the above example, a tube pump has been used to perform a suction operation by changing a volume in the tube by flattening and squeezing the tube To differentiate the volume change among different ink supply systems during the suction-based recovery operation on the print head units, the ink discharge tubes of different inner diameters, essentially circular and connected to the cap units, are used. However, in this case, the requirement of differentiating the ink flow during the suction operation among the groups of discharge portions does not limit the configuration to the one that uses the ink discharge tubes of different inner diameters, but allows for an adoption of other configurations in which effective cross-sectional areas of ink flows and/or flow rates are properly differentiated among the different groups of ejection portions. Further, as a suction means, a piston pump and a gear pump may be used instead of the tube pump that performs suction by a volume change.

The present invention has been described in detail with respect to preferred embodiments, and it will now be apparent from the foregoing to those skilled in the art that changes and modifications may be made without departing from the invention in its broader aspects, and it is the intention, therefore, that the appended claims cover all such changes and modifications.

This application claims priority from Japanese Patent Application No. 2004-031330 filed Feb. 6, 2004, which is hereby incorporated by reference herein.

What is claimed is:

1. An ink jet printing apparatus comprising:

a print head unit having a plurality of ejection portions;

a first cap for capping a first ejection group including a first number of ejection portions out of the plurality of ejection portions;

a second cap for capping a second ejection group including a second number, greater than the first number, of ejection portions out of the plurality of ejection portions;

a first tube communicating with said first cap;

a second tube communicating with said second cap; and a suction pump provided common to said first and second tubes for generating a negative pressure in said first and second caps, wherein an inner diameter of said second tube is larger than that of said first tube so that an amount of ink sucked out from each ejection portion included in the first ejection group is equal to an amount of ink sucked out from each ejection portion included in the second ejection group when ink is sucked out from the first and second ejection groups by said first and second caps.

2. An ink jet printing apparatus according to claim 1, wherein each of the first tube and second tube have a flexible portion in at least a part thereof, and the suction pump comprises a tube pump that performs the suction operation by pushing and squeezing the flexible portion.

3. An ink jet printing apparatus according to claim 1, further comprising means for controlling the apparatus to perform a recovery operation by sucking out ink from a plurality of ink ejection portions, wherein, prior to performing the recovery operation, the plurality of ink ejection portions are made to perform ink ejections not associated with a printing operation, and according to a temperature rise characteristic observed during the ink ejections, a decision is made as to whether the recovery operation should be performed simultaneously for all of the plurality of ink ejection portions or for each group independently.

4. An ink jet printing apparatus according to claim 1, further comprising:

a first atmosphere opening valve capable of linking the inside of said first cap to the atmosphere when the first ejection group is capped by said first cap; and a second atmosphere opening valve capable of linking the inside of said second cap to the atmosphere when the second ejection group is capped by said second cap, wherein the ink is sucked out from one of or both of the first and second ejection groups by controlling the first and second atmosphere opening valves.

* * * * *